US007954736B2

(12) United States Patent
Kallenbach

(10) Patent No.: US 7,954,736 B2
(45) Date of Patent: Jun. 7, 2011

(54) BRUSH CHIPPER IN-FEED SYSTEM

(75) Inventor: Mikel Kallenbach, Jamestown, ND (US)

(73) Assignee: Duratech Industries International Inc., Jamestown, ND (US)

( * ) Notice: Subject to any disclaimer, the term of this patent is extended or adjusted under 35 U.S.C. 154(b) by 246 days.

(21) Appl. No.: 12/165,971

(22) Filed: Jul. 1, 2008

(65) Prior Publication Data

US 2010/0001107 A1 Jan. 7, 2010

(51) Int. Cl.
*B02C 25/00* (2006.01)

(52) U.S. Cl. ..... 241/34; 241/92

(58) Field of Classification Search ..... 241/34, 241/35, 92; 144/402, 404, 394, 392, 176
See application file for complete search history.

(56) References Cited

U.S. PATENT DOCUMENTS

| | | | | |
|---|---|---|---|---|
| 3,661,333 | A | 5/1972 | Smith | 241/281 |
| 3,955,765 | A | 5/1976 | Gaitten | 241/28 |
| 4,078,592 | A | 3/1978 | Standal | 144/208 |
| 4,419,384 | A | 12/1983 | Kane et al. | 427/57 |
| 4,510,981 | A | 4/1985 | Biller | 144/246 |
| 4,536,852 | A | 8/1985 | Hosel | 364/562 |
| 4,665,786 | A | 5/1987 | Shields | 83/364 |
| 5,020,579 | A | 6/1991 | Strong | 144/176 |
| 5,505,291 | A | 4/1996 | Huang et al. | 198/460.3 |
| 6,211,470 | B1 | 4/2001 | Beran et al. | 177/16 |
| 6,463,402 | B1 | 10/2002 | Bennett et al. | 703/2 |
| 7,232,083 | B2 | 6/2007 | Stelter et al. | 241/30 |
| 2003/0111566 | A1 | 6/2003 | Seaman et al. | 241/34 |
| 2007/0108323 | A1 | 5/2007 | Chapman et al. | 241/30 |
| 2009/0084876 | A9 * | 4/2009 | Chapman et al. | 241/30 |

* cited by examiner

*Primary Examiner* — Mark Rosenbaum
(74) *Attorney, Agent, or Firm* — Westman, Champlin & Kelly PA

(57) ABSTRACT

A wood chipper has a pair of feed rollers, a first of which has a fixed axis position, and a second of which is moveably toward and away from the first feed roller. Springs are provided to urge the moveable roller toward the first feed roller and to a reference position, and an actuator is provided for moving the moveable feed roller away from the first feed roller. A sensor is provided to sense the height of an object on a feed chute as the object approach the feed rollers and cause the actuator to move moveable feed roller away from the reference when the sensor signals the object exceeds a selected amount.

19 Claims, 5 Drawing Sheets

20
10
18
70
68
94
96,104
50
63
62
52
54
42
76
76
60
90
66
74
40
56
54
38
92
64
74
36
27
26
80
78
28

BRUSH CHIPPER IN-FEED SYSTEM

BACKGROUND OF THE INVENTION

The present disclosure relates to controlling the infeed throat opening of a wood chipper that is used for processing brush and logs, and which has a sensor to sense when incoming dense material exceeds a selected height, and causing the feed throat to open momentarily in order to feed a log or other dense, solid material into a chipper rotor. As shown, an upper feed roller is raised to open the throat. After a timed interval the lifting force is released to permit the upper feed roller to bear against the material being fed with the normal spring force applied to the feed roller.

Various brush chippers have been advanced, and they generally have a powered chipper rotor that will disintegrate brush, logs or the like that are fed into a chipper rotor. Prior chippers have springs or actuators to provide a force bearing on incoming feed material, and have in some manner sensed the load on or speed of the rotor or chipper wheel and provided for various corrective action when the load exceeded a certain level. The sensors used may be sensing drive engine speed, hydraulic pressure, if the unit is driven with hydraulic motors, or other sensors that sense when the chipper disc or rotor starts to slow. In addition there are automatic reversing drives which will reverse the in-feed roller direction of rotation when the load on the chipper rotor exceeds a certain load level.

Additionally, many of the existing brush chippers have operator controls to permit the operator to manually move or raise an in-feed roller to accommodate large material that normally would not be fed because of the throat size of the in-feed passage.

SUMMARY OF THE INVENTION

The present disclosure provides for a control to adjust the in-feed opening of a chipper when oversize material is being fed in. As shown, the space between a pair of in-feed members of a chipper is increased in response to receiving a signal indicating that the height of the in-feed material relative to a reference is greater than a selected amount measured in the direction of movement of a movable in-feed member. A first moveable in-feed member, a feed roller as shown, is moved relative to a second in-feed member or roller in response to the signal. The movement of the first in-feed member increases the spacing between the pair of in-feed members for a selected short period of time to permit the large size material to be fed into the chipper disc or rotor, after which the moveable member is released from the force separating the feed members and the first in-feed member is held against the material being fed by springs in a normal manner.

As shown, an ultrasonic sensor measures the distance from a reference position to the top of an item being fed into the in-feed members, (called rollers) of the chipper, and provides a signal indicating that a selected distance of the material top from the reference has been exceeded to a controller that controls various operations of the chipper. The controller sends a signal to actuate an actuator to move the first moveable in-feed roller away from the second in-feed roller. The moveable roller is mounted on a framework that is moved by the actuator. The actuator shown is a hydraulic actuator that has an outer cylinder with a base that is mounted on a support fixed relative to the frame of the chipper, and a piston rod is extendible to move the moveable roller away from the second roller, which second roller, in the form shown is a stationary axis roller.

Additional controls that may be provided in certain aspects of the present disclosure include, if desired, a switch that will provide for changing the in-feed roller speed to accommodate brush chipping or log chipping. Such a switch can also be used to control the activation or deactivation of the sensor actuated in-feed roller lift system. When the higher feed roller speed is selected, which is for chipping brush, the system including the sensor and actuator for moving the first infeed roller system will be deactivated, but when logs are being fed into the chipper, and a lower feed roller speed is selected, the feed roller moving or lift system, including the ultrasonic sensor, will be activated. Generally speaking, brush has smaller diameter limbs, and it is not very dense, and if the feed roller moving system is activated, the sensor could provide a false signal and by then separating the feed rollers, the feed rollers could lose their grip on the brush being fed.

The moveable feed roller is preferably moved proportionally to the height signal being provided by the sensor. Closed loop control can be established by providing a linear sensor on the cylinder or actuator that lifts the moveable feed roller to measure the actual amount of extension of the piston rod of the actuator, and providing a signal to the controller.

The chipper shown may have additional conventional controls for sensing engine speed of the engine driving the chipper rotor, and controls for reversing the feed rollers when the chipper rotor is loaded excessively, as well as providing necessary pressure sensors on the in-feed rollers for reversing the in-feed rollers if there is a jam. Controlling reverse and forward movement of the feed rollers in response to hydraulic pressure levels is a known control and can be used along with the present device, which ensures that the feeding of logs, in particular, will be possible by having the moveable feed roller moved to provide a larger feed throat when a large log is being fed.

In the form shown, the brush or logs are fed manually, but suitable feed conveyors can be provided if desired for moving materials to be chipped and obtaining the benefits of the present in-feed system.

DETAILED DESCRIPTION OF ILLUSTRATIVE EMBODIMENTS

Figure 1:
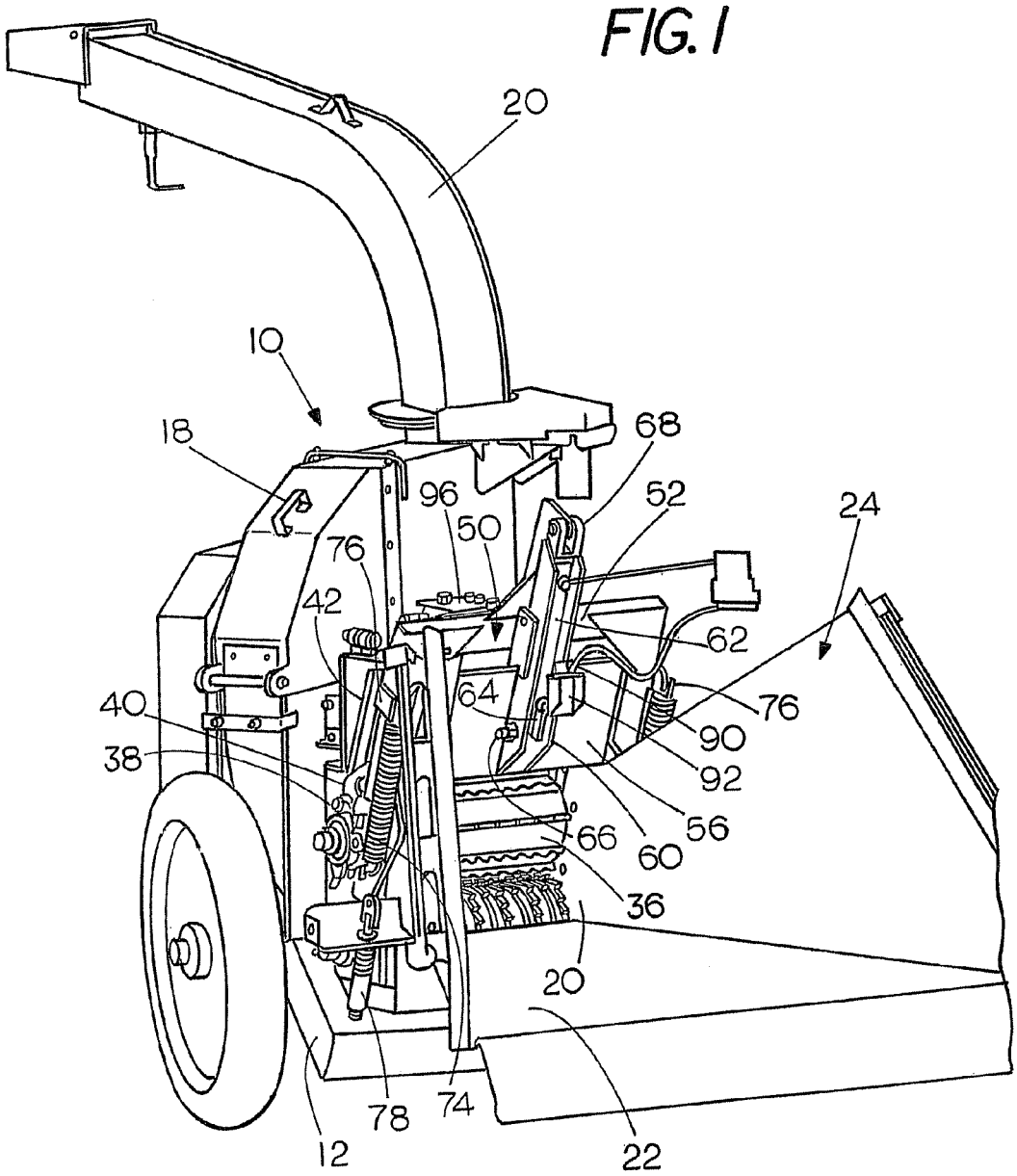
FIG. 1 is a perspective view of a chipper having a feed throat adjustment wheel lift system made according to the present disclosure installed thereon.

A brush or log chipper is indicated generally at 10. As shown, it can be a mobile unit that has a trailer schematically shown at 12 for transporting it from place to place, and the trailer would support an engine 16, which is shown only schematically in FIG. 5, for driving a chipper disc or rotor 14, again shown schematically in FIG. 5.

The chipper rotor 14 is conventional and is positioned inside a rotor or disc housing 18, that has a discharge chute 20 that can be directed to discharge the chips formed in a suitable direction, as is well known. The chipper rotor 14 can be of any desired form, and is driven so that it will chip brush or logs that are fed into the chipper rotor along a feed platform 22.

Figure 2:
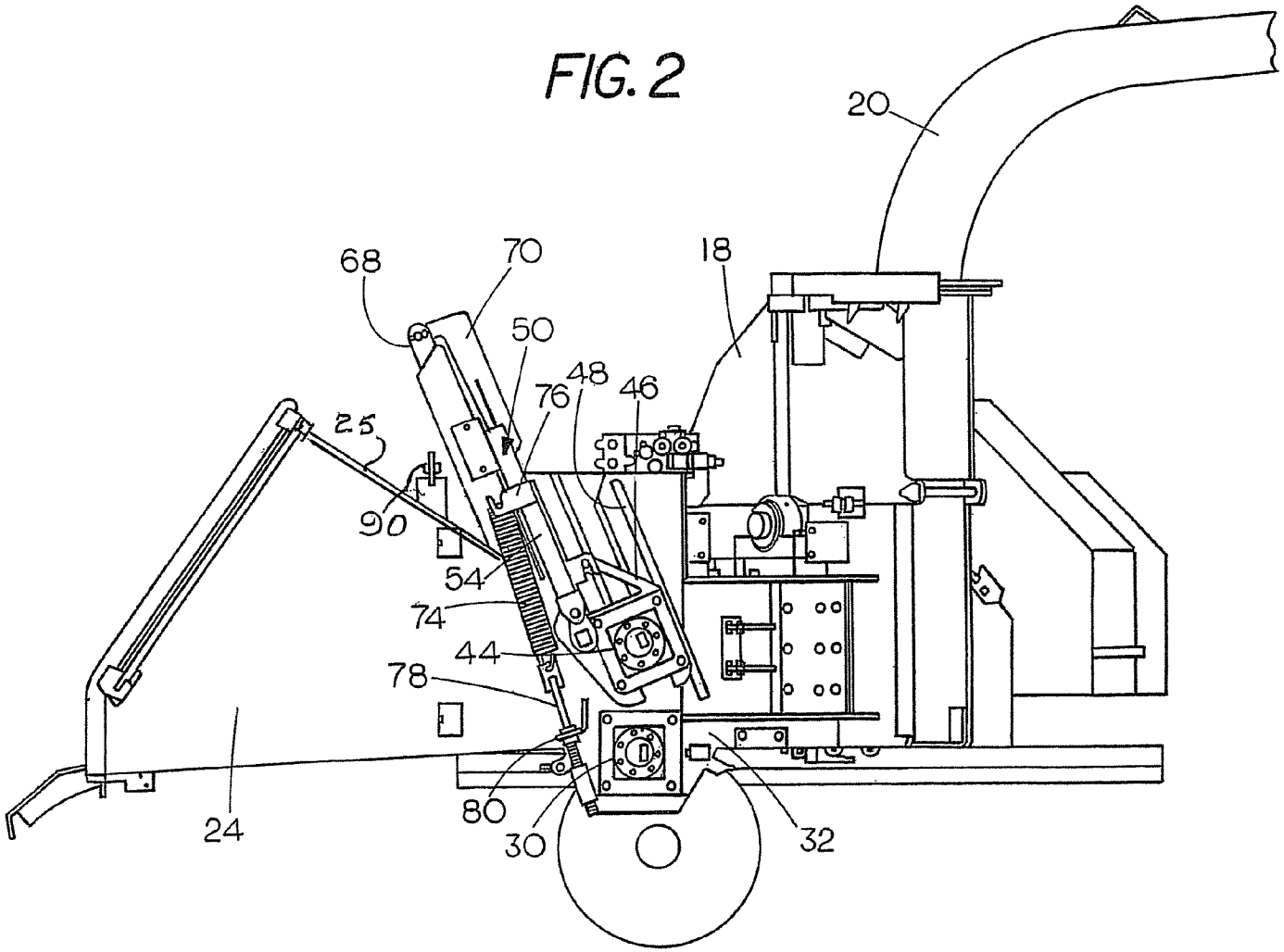
FIG. 2 is a side elevational view of the device of FIG. 1 viewed from an opposite side.
Figure 3:
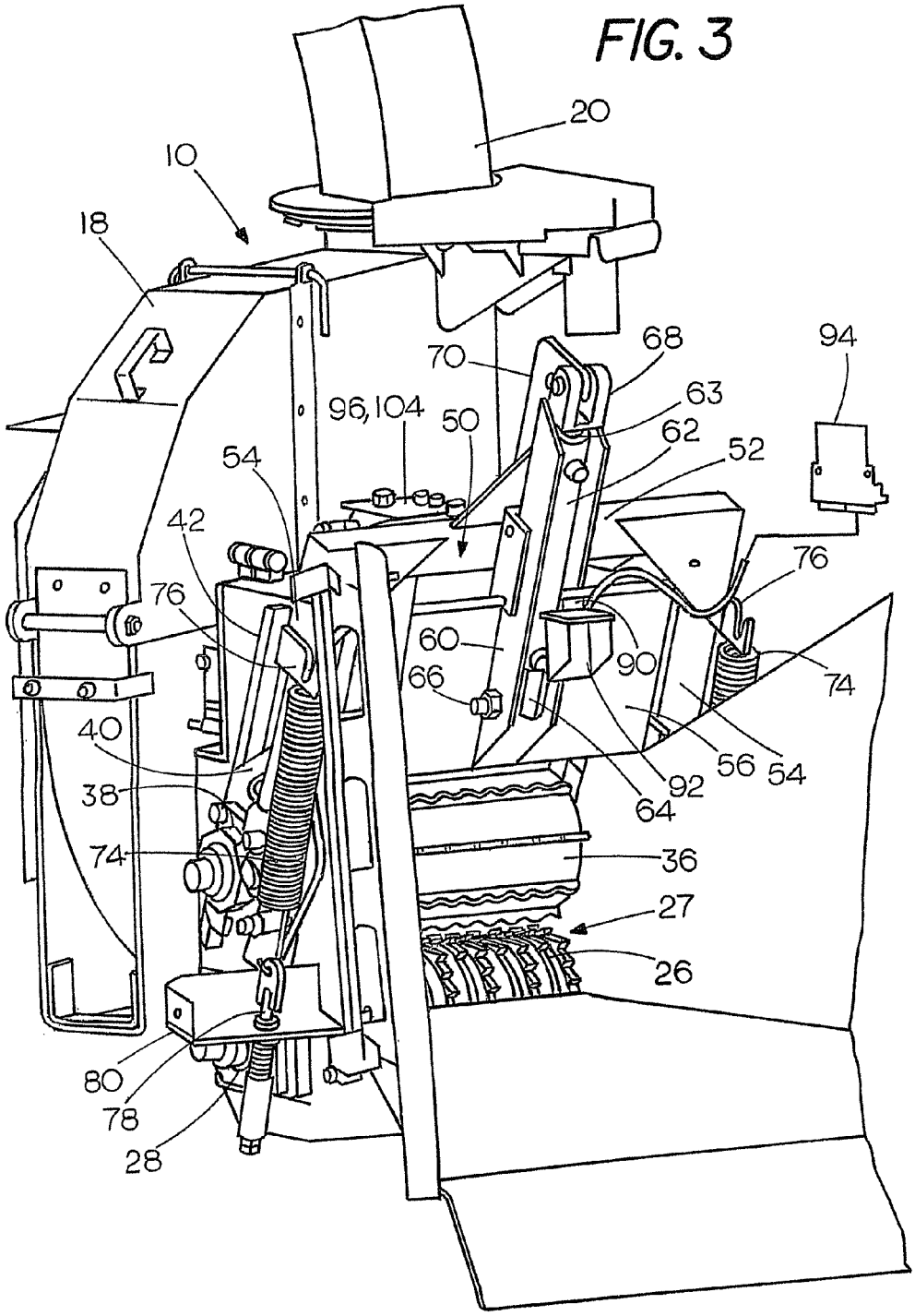
FIG. 3 is an enlarged perspective view of a portion of FIG. 1.
Figure 4:
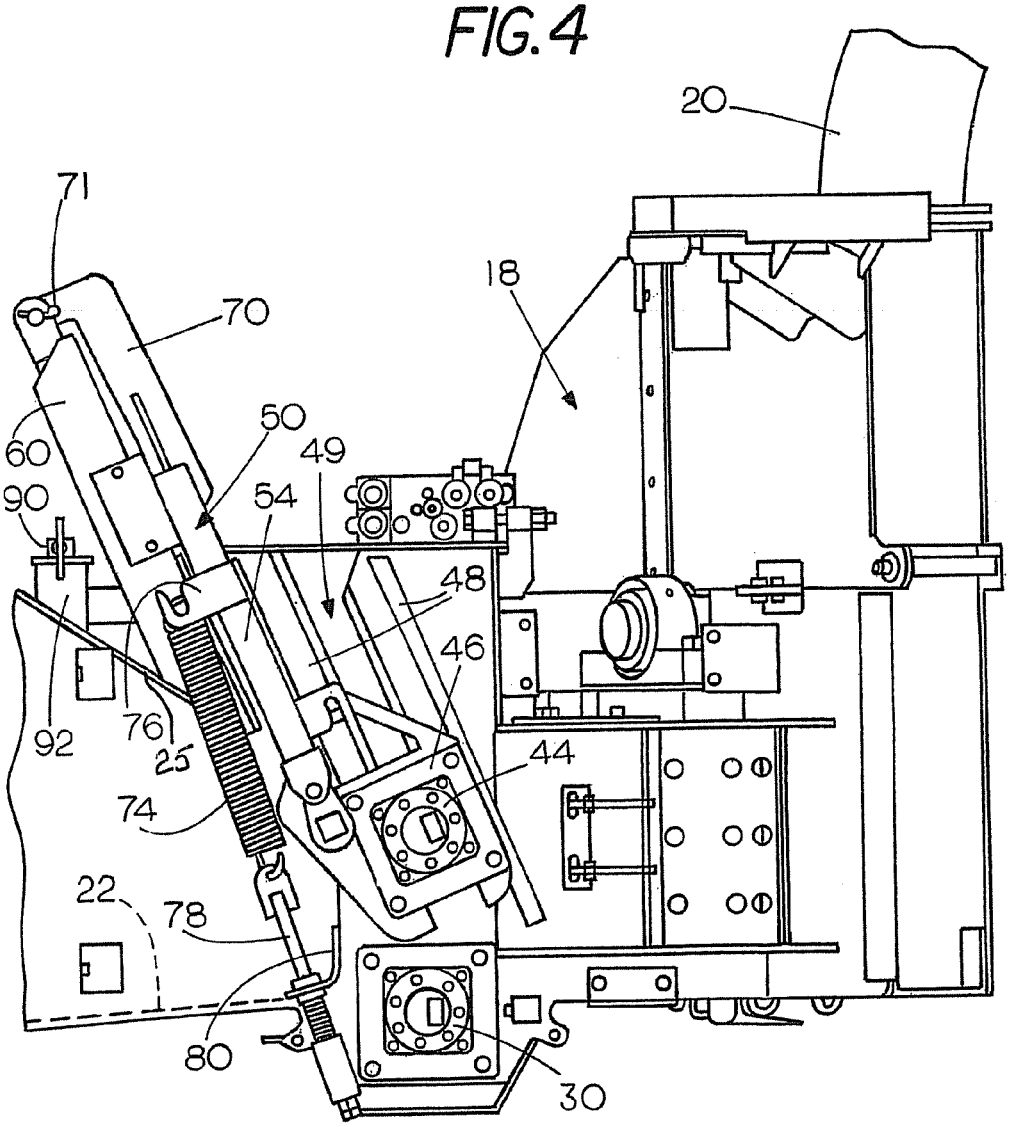
FIG. 4 is an enlarged side view of a portion of FIG. 2.

The feed platform 22 is part of a feed housing 24 or in-feed chute that is shown schematically in FIG. 1. The housing or in-feed chute includes side walls and the platform 22 and also a top wall 25, shown in FIG. 2. The feeding of logs or brush along the platform 22 is manual, or in other words, the material being fed for chipping is moved by an operator along the platform 22. A stationary axis in-feed member or roller 26 is rotatably mounted on suitable bearings 28 as shown in FIGS. 1 and 3. On the opposite side of the machine as shown in FIGS. 2 and 4, the stationary axis in-feed roller 26 is connected to be driven by a hydraulic motor 30, and can be supported right on the motor shaft. The motor is connected to the frame 32 of the chipper. The bearing 28 is also connected to the frame of the chipper, as is the chipper rotor housing 18 and other components.

A moveable in-feed member or roller 36 is positioned above the stationary axis in-feed roller 26, in the form shown and is mounted on a slide 40 on the side shown in FIGS. 1 and 3. The slide 40 can move generally up or down along slide guides or tracks 42. The space between the feed rollers 26 and 36 forms an in-feed throat 27. The slide guides 42 are provided on the side of the chipper shown in FIGS. 1 and 3, and the movable roller 36 is supported on bearing 38 that is attached to the slide 40. The opposite side of the moveable in-feed roller 36 is supported on and driven by a hydraulic motor 44 that is mounted on a slide 46 for movement along slide guides 48 that parallels slide guides 42. The guides 48 and 42 provide guides for the moveable roller 36 for movement in a path toward and away from the fixed axis in-feed roller 26 along slots 49 in the chipper frame. The guides 48 are attached to portions of the chipper frame. Slides 40 and 46 are connected to a yolk style lift bracket 50. The lift bracket 50 has a cross member 52 that can be seen in FIGS. 1 and 5 and downwardly extending arms 54 on opposite sides of the frame. Each of the arms 54 is connected to one of the slides 40 and 46, respectively. The moveable feed roller lift bracket 50 thus spans the upper or moveable feed roller, and it is moveable to move the slides 40 and 46 along the guides 42 and 48.

The in-feed mechanism shown comprises infeed members formed by powered rollers, which are commonly used in chippers. Instead of rollers, a short aggressive conveyor can be mounted for moving material to the chipper rotor. Powered rollers that rotate about vertical axis can be used as well, with one roller being movable horizontally to change the throat size.

Figure 5:
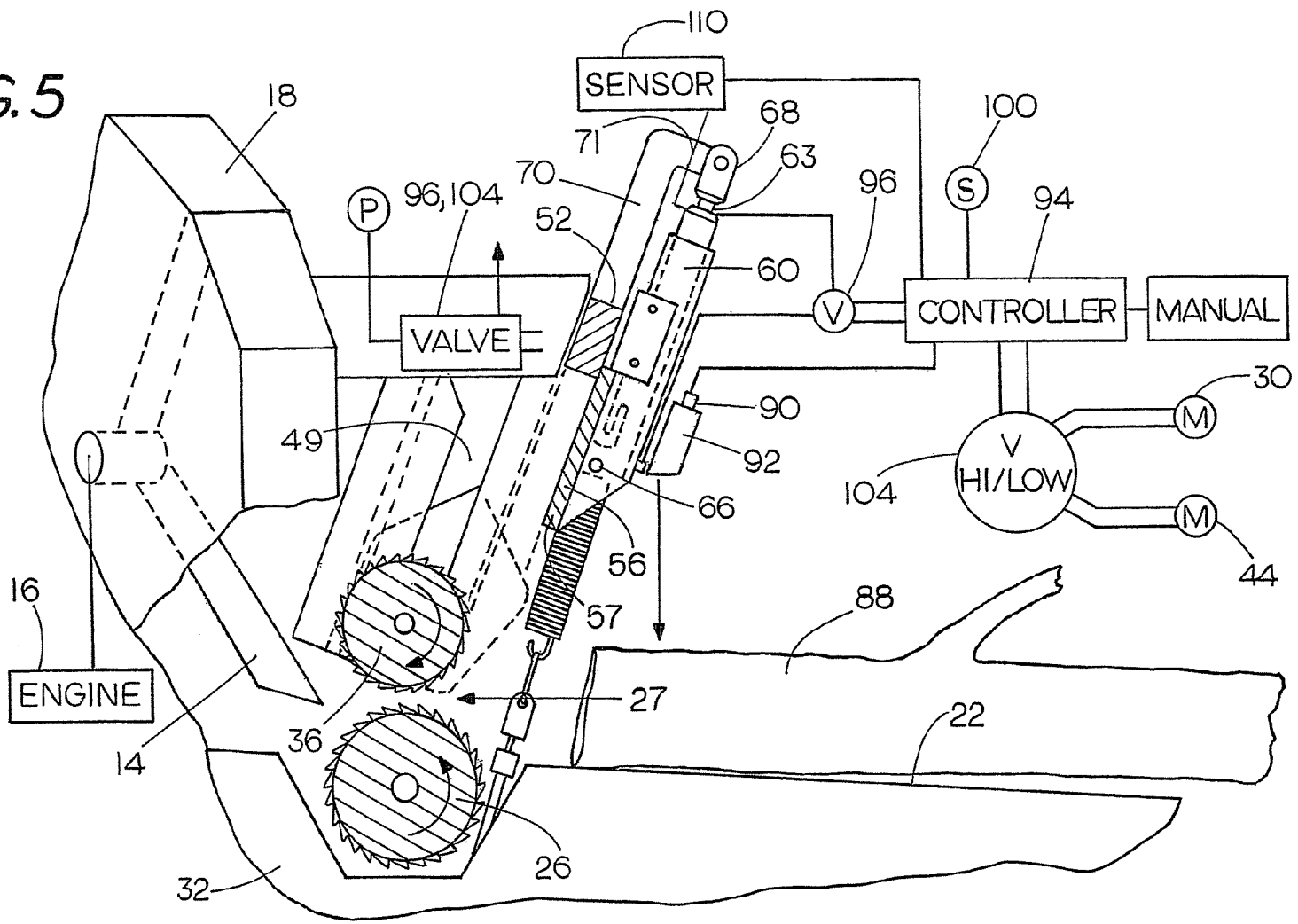
FIG. 5 is a schematic longitudinal sectional view of the chipper of the present disclosure.

The frame 32 of the chipper includes a fixed cross plate 56 (FIGS. 1 and 3) that extends between uprights that are fixed to the chipper frame 32, and support the cross plate 56 at a position so that its lower edge 57 is spaced a selected distance above the platform 22, as can be seen in FIG. 5. The cross plate 56 has a channel shaped lift actuator bracket 60 mounted thereon, and as can be seen the bracket 60 extends in a generally upright direction generally parallel to the slide guides 42 and 48. A hydraulic lift cylinder or actuator 62 is mounted in the channel shaped bracket 60. The hydraulic actuator has a base 64 that is secured to the bracket 60 with a suitable pin 66, and has an extendable and retractable piston rod 68 that is coupled to a lift bracket arm 70 which is connected to cross member 52 of lift bracket 50. The arm 70 as shown has an end 71 that is coupled to an end device on the piston rod 68.

The base of the clevis of piston rod 68 is made so that it will stop against an upper end 63 of the actuator 62, and this provides a fixed stop for stopping movement of the upper or moveable feed roller 36 toward the lower or stationary axis feed roller 26. The upper moveable feed roller 36, and the slides 42 and 46 as well as the lift bracket 50 are urged toward this stopped position by a pair of springs 74, one on each of the opposite sides of the chipper frame. The springs 74 have first ends anchored in respective brackets 76 that are connected to the lift bracket 50, and the other ends of the spring 74 are connected to adjustable rods 78 that are mounted on fixed brackets 80 on the frame 32 of the chipper. Springs 74 exert a resilient biasing force tending to urge the upper or moveable feed roller 36 toward the stationary axis feed roller 26. Again the most downward position, or where the moveable feed roller is the closest to the stationary axis feed roller, is determined by the positioning of the actuator 62 and the stopping of the piston rod 68 in its inward travel. This position defines the smallest throat size for the chipper in-feed.

It can be seen that extension of the piston rod 68 will cause the bracket 50 to be lifted through the bracket arm 70 and cross plate 52, and this in turn will lift the slides 40 and 46 and the moveable roller 36 in a direction away from the stationary axis feed roller 26.

As illustrated in FIG. 5, when a large log shown at 88 is fed along platform 22, the "bite" or throat 27 size between the fixed axis feed roller 26 and the moveable feed roller 36 is such that the log will not feed easily into these rollers. The moveable feed roller under normal circumstances, will rise against the tension of the springs 74 to accommodate different sizes of brush, logs or branches, but when large logs such as that shown at 88 are fed, the spring loaded movable roller may not feed such a log.

In order to accommodate large logs such as that shown at 88, an ultrasonic sensor 90, which is mounted onto a bracket 92 that in turn is attached to the top wall 25 of feed housing 24 (FIG. 2) is provided at a location above the in-feed platform 22, and is generally centered on the feed rollers. The ultrasonic sensor 90 is a sensor that is commercially available and is excited from a controller 94 so that it will sense the height of the uppermost portion of a large log such as at 88 and provide a signal back to the controller 94 that is proportional to that height or distance from the platform 22, which is a reference. The controller 94 will process that height or distance signal to in turn control a valve shown schematically at 96 that will provide fluid under pressure at the base end of the actuator 62, to lift the moveable roller 36 by extending the rod 68 and acting through the bracket arm 70 and the lift bracket 50.

Controller 94 includes a circuit to provide a time signal having a length that is proportional to the signal from the ultrasonic sensor. In other words, the greater the height signal, the longer the valve 96 will keep the moveable roller raised. One also can have an adjustable timer for limiting the time of actuation of the valve 96. For example, after 3 seconds or other selected time interval, or when the proportional time signal expires, the control valve 96 can be actuated to release the pressure at the base end of the hydraulic actuator 62 and place the valve 96 in a "float" position. The float position will permit oil to flow out of the base end of the actuator and into the rod end of the actuator so that the springs 74 will exert a down force on the feed roller 36. The initial raising of the feed roller 26 will be sufficient so an operator can place the log 88 in a position where the rollers will drive it toward the chipper rotor. The moveable feed roller 36 will be raised sufficiently to permit the log to enter between the feed rollers and be moved to be disintegrated by the rotor 14 of the chipper.

The controller 94 includes a manual switch shown schematically at 100 that controls a valve 104 to provide different flows of hydraulic fluid for driving the hydraulic motors 30 and 44 for the feed rollers selectively at a high speed or at a low speed. The higher speed is utilized for brush, with less dense material and branches, and the roller lift system, and ultrasonic sensor 90, will be disabled by the controller when the higher feed roller speed is selected. When the lower feed roller speed is selected with switch 100, for feeding in logs, the ultrasonic sensor 90 and the controls for the valve 96 to the lift actuator 62 will be enabled or activated, in the form disclosed.

The sensor 90 and the lift system can be disabled and the valve 96 left in its float position as brush or very loose material is being fed, for example, because branches and twigs can collapse together. If piles of branches and brush reach the sensing position of the ultrasonic sensor, the sensor could signal that the moveable feed roller should be raised. The feed rollers could lose their grip as the branches and twigs collapse. The lift of the movable feed roller is only for a short time span, as disclosed, so the rollers again will move together and usually there is no problem with feeding even if the lift system is operating at a high selected speed.

The chipper controls include manual controls, where an operator can operate the lift actuator 62 by manually extending the piston rod or manually placing the valve for actuator 62 into a "float" position. The manual controls will permit an operator to add a force on the movable roller in the direction toward the stationary roller that is greater than the spring loading force, if desired. By setting a relief valve in the line to the rod end of the actuator at a desired level or by providing an accumulator in the line, the hydraulic lift actuator can provide a bias force to return the movable roller to its reference position. Also the chipper includes sensors for engine speed, hydraulic pressure or the like to either stop, reverse and again start the feed wheels or rollers in accordance with conventional operation.

A closed loop control system can be provided to the controller 94 for controlling the amount of the extension of the piston rod 68 of the actuator. This can be done with a linear sensor, and these sensors are well known. Such a piston rod extension sensor is shown schematically at 110. This is shown only schematically because the sensors can be built right into the cylinder. The controller 94 receives the signal from the sensor 90 indicating the height of the incoming log, and operates valve 96 to move cylinder to raise the moveable roller, and the signal from sensor 110 is compared with the signal from sensor 90 to insure the cylinder 62 extends the proper amount. A closed loop control also insures that the extension of the actuator rod 68 does not exceed the material height signal from the ultrasonic sensor. When a closed loop system is used, the sensor in the actuator can be used to "arm" or make ready the height detecting system, when the movable feed roller returns to its working or reference position closest to the stationary roller.

If needed the controller can be programmed to provide additional time if the incoming log is not fed into the feed rollers during the proportional time or fixed time from the timer. If the time that the controller sets for pressurizing the base end of the actuator expires, and the sensor 90 still senses excessive height of the incoming log, the controller could provide an extra time period for keeping the moveable roller raised. A manual push button also could be used to extend the time the moveable roller is raised by the actuator 62.

It should also be noted that the control of the actuator could be a simple on/off valve that pressurized the actuator when the sensor signal indicated presence of high material and released the actuator when the signal ceased.

Although the present invention has been described with reference to preferred embodiments, workers skilled in the art will recognize that changes may be made in form and detail without departing from the spirit and scope of the invention.

What is claimed is:

1. An apparatus for reducing debris material of varying size comprising a frame including a debris material in-feed chute, a rotor for reducing the debris material to chips, a pair of feed rollers, including a first feed roller, and a second feed roller on the frame mounted for movement away from a first reference position relative to the first feed roller, a bias force member urging the second feed roller toward its reference position, an actuator assembly operably connected to said second feed roller for exerting a force to move the second feed roller in a direction away from the first feed roller, a sensor positioned to provide a signal which is a function of the height of debris material on the in-feed chute adjacent the feed rollers, and a controller to receive the signal from the sensor and to actuate the actuator and move the second feed roller away from its reference position to increase spacing between the first and second feed rollers for feeding the debris material in response to and as a function of the signal from the sensor.

2. The apparatus of claim 1, wherein said controller disables the actuation of the actuator after a determined time period to permit the second feed roller to return toward its reference position under the force of the bias force member following receipt of the signal from the sensor.

3. The apparatus of claim 1, wherein the first feed roller has a fixed substantially horizontal axis.

4. The apparatus of claim 1, wherein said frame supports slide guides extending in a direction away from the first feed roller, and slides for supporting opposite ends of the second feed roller for movement along the slide guides.

5. The apparatus of claim 1, wherein said bias force member urging said second feed roller toward its reference position comprise tension springs exerting a force between the frame and the second feed roller to tend to move the second feed roller to its reference position.

6. The apparatus of claim 1, wherein said second feed roller is mounted on slide brackets, said slide brackets being connected to a lift bracket having a cross member extending across the in-feed chute, the actuator being connected to move the cross member when actuated by the controller.

7. The apparatus of claim 1, wherein said sensor comprises an ultrasonic sensor which senses the height of debris material on a platform of the in-feed chute, and provides a signal proportional to the height of debris material sensed.

8. The chipper of claim 7 wherein the actuator has an extendable rod and a second sensor to provide a rod extension signal proportional to the amount of extension of the rod, the controller controlling the amount of extension of the rod by correlating the rod extension signal and the ultrasonic sensor signal.

9. The apparatus of claim 1, wherein the first and second feed rollers are driven by motors having at least first and second different speeds of rotation, and a switch for selecting one of the speeds of rotation.

10. The apparatus of claim 9, wherein the first speed is a higher speed of rotation than the second speed, the switch disabling the sensor when the switch is operated to select the first speed of rotation.

11. A chipper for reducing pieces of material of varying sizes comprising a frame including a material in-feed chute, a rotor for reducing the pieces of material to chips, a material in-feed mechanism having an in-feed throat defined by at least one material in-feed member on the frame mounted for movement away from a first reference position defining a first size in-feed throat, a bias force member urging the at least one material in-feed member toward the first reference position, an actuator operably connected to the at least one material in-feed member, a sensor positioned adjacent the material in-feed throat, and at location spaced from a second reference position on the in-feed chute to provide a signal when the material on the in-feed chute adjacent to and spaced from the in-feed throat exceeds a desired distance from the second reference position, and a control to actuate the actuator to move the at least one material in-feed member away from the first reference position in response to the signal from the sensor to receive the material sensed by the sensor.

12. The chipper of claim 11, wherein said sensor provides a signal proportional to height of material on the in-feed chute exceeding the desired distance, the controller disabling the actuation of the actuator to permit the at least one material in-feed member to return toward its first reference position under the force of a bias member urging the at least one material in-feed member toward its first reference position after the signal from the sensor ends.

13. The chipper of claim 12, wherein the at least one material in-feed member is a first feed roller, and a fixed substantially horizontal axis second feed roller spaced from the first feed roller to define the in-feed throat.

14. The chipper of claim 13, wherein the feed rollers are driven by motors each having at least first and second different speeds of rotation, and a switch for selecting one of the speeds of rotation for both of the motors.

15. The chipper of claim 14, wherein the first speed is a higher speed of rotation than the second speed, the switch disabling the sensor when the switch is operated to select the first speed of rotation.

16. The chipper of claim 11, wherein said sensor comprises an ultrasonic sensor providing a signal proportional to the amount the material on the in-feed chute exceeds the desired distance and wherein the control comprises a controller to actuate the actuator to move the at least one material in-feed member away from the first reference position a distance that is a function of the signal from the ultrasonic sensor.

17. An apparatus for reducing pieces of material of varying sizes into chips, comprising a frame including a material in-feed chute, first and second powered rollers for reducing the pieces of material to chips, a material in-feed mechanism having an in-feed throat defined by the first and second rollers, the second roller being mounted on the frame and movable from a first reference position defining a first size in-feed throat with the first roller, an actuator operably connected to the second roller, a sensor positioned adjacent the material in-feed throat, and at location above a platform of the in-feed chute to provide a signal when the height of material in-feed on the platform of the in-feed chute adjacent to but spaced from the in-feed throat exceeds a reference height, the sensor providing a signal proportional to the amount the in-feed material exceeds the reference height, and a control to actuate the actuator to move the second roller away from the first roller in response to and as a function of the signal from the sensor.

18. The apparatus of claim 17, further comprising the controller being operable to disable the actuation of the actuator to permit the second roller to return toward its first reference position under the force of a bias force member urging the first roller toward its first reference position after the signal from the sensor ends.

19. The apparatus of claim 18, wherein the first roller is mounted for rotation about a fixed axis.

* * * * *